US005964650A

United States Patent [19]

Born et al.

[11] Patent Number: 5,964,650

[45] Date of Patent: Oct. 12, 1999

[54] METHOD AND APPARATUS FOR REPAIRING OPTICAL DISCS

[75] Inventors: Joseph Born, Lincolnwood; Collin D. Anderson, Chicago; Stephen K. Spatig, Highland Park, all of Ill.

[73] Assignee: Digital Innovations, L.L.C., Evanston, Ill.

[21] Appl. No.: 09/036,892

[22] Filed: Mar. 9, 1998

Related U.S. Application Data

[60] Provisional application No. 60/040,102, Mar. 10, 1997.

[51] Int. Cl.[6] ..... B24B 7/19; B24B 7/30

[52] U.S. Cl. ..... 451/63; 451/526

[58] Field of Search ..... 451/28, 63, 57, 451/490, 526, 508

[56] References Cited

U.S. PATENT DOCUMENTS

| | | | |
|---|---|---|---|
| 1,335,352 | 3/1920 | Slowey . | |
| 1,343,156 | 6/1920 | Prinz . | |
| 2,266,875 | 12/1941 | LeBel | 274/47 |
| 3,808,753 | 5/1974 | Maran | 51/358 |
| 4,107,810 | 8/1978 | Varni et al. | 15/97 |
| 4,149,294 | 4/1979 | MacKay, Jr. et al. | 15/230.12 |
| 4,202,071 | 5/1980 | Scharpf | 15/302 |
| 4,240,483 | 12/1980 | Gregoric | 152/75 |
| 4,365,448 | 12/1982 | Wilson | 51/334 |
| 4,368,756 | 1/1983 | Carlson | 137/541 |
| 4,451,836 | 5/1984 | Leonard et al. | 346/137 |
| 4,462,036 | 7/1984 | Leonard et al. | 346/137 |
| 4,476,601 | 10/1984 | Oka | 15/21 D |
| 4,504,999 | 3/1985 | Pedrotte | 15/230.1 |
| 4,520,470 | 5/1985 | d'Alayer de Costemore | 369/72 |
| 4,556,433 | 12/1985 | Clausen | 134/6 |
| 4,561,142 | 12/1985 | Mischenko et al. | 15/97 |
| 4,654,917 | 4/1987 | Yeung | 15/97 R |
| 4,662,025 | 5/1987 | Fritsch | 15/246 |
| 4,709,437 | 12/1987 | Hehn et al. | 15/97 R |
| 4,713,856 | 12/1987 | Clausen | 15/97 R |
| 4,750,231 | 6/1988 | Kogashiwa | 15/97 R |
| 4,783,870 | 11/1988 | Yeung | 15/97 R |
| 4,825,497 | 5/1989 | Nagao et al. | 15/97 R |
| 4,854,001 | 8/1989 | Mannheimer et al. | 15/97 R |
| 4,860,611 | 8/1989 | Flanagan et al. | 74/574 |
| 5,090,078 | 2/1992 | Kamakura et al. | 15/97.1 |
| 5,099,618 | 3/1992 | Schmid | 51/326 |
| 5,101,602 | 4/1992 | Hashimoto | 51/216 P |
| 5,146,382 | 9/1992 | Yao-Ko | 360/137 |
| 5,228,022 | 7/1993 | Compton et al. | 369/72 |
| 5,292,567 | 3/1994 | Foster | 428/64 |
| 5,297,366 | 3/1994 | Huddleston | 51/376 |
| 5,423,103 | 6/1995 | Born | 15/97.1 |
| 5,593,343 | 1/1997 | Bauer | 451/254 |
| 5,733,179 | 3/1998 | Bauer | 451/41 |

FOREIGN PATENT DOCUMENTS

| | | |
|---|---|---|
| 4372785 | 12/1992 | Japan . |
| 5 12832 | 1/1993 | Japan . |
| 5159528 | 6/1993 | Japan . |
| 5303871 | 11/1993 | Japan . |

OTHER PUBLICATIONS

Packaging for discwasher, CD–2™ CD Polish and Scratch Remover System, Discwasher, Inc., 1989, 2 pages.

"Removing Scratches on Compact Disks," The New York Times, Jun. 5, 1995, 1 page.

*Primary Examiner*—Joseph J. Hail, III
*Assistant Examiner*—Dermott J. Cooke
*Attorney, Agent, or Firm*—Lloyd L. Zickert

[57] ABSTRACT

A method and apparatus for repairing optical discs, wherein the apparatus includes an improved buffing wheel capable of applying a uniform buffing action across the readable surface of an optical disc, and wherein the method includes the step of mechanically buffing the damaged area of a disc with an abrasive means and thereafter buffing the buffed area with a non-abrasive means to remove fine scratches caused by the abrasive means.

25 Claims, 2 Drawing Sheets

METHOD AND APPARATUS FOR REPAIRING OPTICAL DISCS

This application claims the benefit of U.S. provisional application Ser. No. 60/040,102, filed Mar. 10, 1997.

This invention relates in general to repairing a damaged optical disc, and more particularly to an improved abrasive/buffing wheel that facilitates a substantially uniform application of force to the surface of the disc to remove scratch damage, and a method using the improved abrasive/buffing wheel in conjunction with a non-abrasive means that, when used preferably in a substantially dry manner and under sufficient pressure, generates sufficient heat to cause the material of the surface of the disc to flow and remove fine scratches induced by the abrading/buffing step.

BACKGROUND OF THE INVENTION

Optical discs are currently used in a variety of ways, including digitally storing computer data, musical compilations or software within the disc. The information stored within the disc is protected by at least one layer of material in such a way that the information may still be read by a laser. Specifically, hundreds of millions of pits are molded into one side of a transparent plastic disc. The pits are arranged so that music or other information is digitally stored in the pits in a helical or spiral pattern, similar to the grooves on a vinyl record. A thin reflective coating or layer is applied to the back of the pits. A protective plastic layer is applied over the reflective layer to protect the coating and the pits. Then a label is applied to the protective layer.

The information stored in these optical discs is read by using one or three laser beams that enter the disc through the transparent plastic (i.e., the "play side" or "read side"). The laser is then reflected back from the reflective layer and passes back through the transparent plastic layer or play side of the disc. When three lasers are used, one reflected laser beam contains the digital information from the pits and is then processed through a device such as a computer, a stereo or a game console. The other two reflected laser beams are used to focus the laser and keep it "on track" as it reads the spinning disc. When only one laser beam is used, the laser reads the data, focuses the laser and keeps the laser on track. In the case of a compact disc, the first track, called the "lead-in" track is a band of data that contains the table of contents for the whole disc. The information in the lead-in track is used by the disc player to quickly locate selected individual songs or other data tracks. Thus, if a person were to select track six on a compact disc, the laser would find the location of track six from the lead in track and then move to that particular location on the disc.

When the play side of the transparent layer is scratched or dirtied, the laser beams may scatter or deviate from their correct optical path as they enter or exit the transparent layer. Such scattering can preclude the proper reading of the data layer. In the case of a compact optical disc, if the tracking beams are scattered, the disc player's closed-loop feedback system might be induced to "thinking" it is off track. It will then try to adjust by jumping either forward or backward. If the player jumps forward, it will "skip" a portion of the music. If the player jumps backward, it will attempt to play until the laser reencounters the scratch and skips backward again. In this way, a portion of data can be repeated indefinitely, causing an obnoxious electronic sound with some players and silence with others. If a scratch limits the readability of the lead-in track, none of the tracks will play because the player would not know where the individual tracks were located.

If only the free surface on the read side of the transparent plastic layer is scratched, the data itself is not harmed. Only the ability to read this data is hindered. Because some disc reading devices allow for the disc to be read even if the transparent layer has certain types of scratches, scratches in optical discs do not necessarily have to be removed completely for a flawless playback. In particular, the size and orientation of the scratch damage to the disc may influence the effect it has on the readability of the disc. For instance, a disc reading device will have a better chance at reading a disc with a radial scratch than a circumferential scratch. A radial scratch would generally be better because the lasers read the information stored in the data layer of the disc in a helical or spiral pattern. Problems thus often can be eliminated by merely smoothing the edges of the scratches and/or reducing their width and depth.

Repairing optical discs requires a level of control that cannot be consistently achieved by hand. Polishing too aggressively can damage discs. Polishing too delicately leaves them unrepaired. Sandpaper kits are often too aggressive and can make a disc unplayable if too much pressure is applied. Polishing solutions are at the other extreme. They use such fine abrasives to avoid burning that they have difficulty repairing even moderate scratches—no matter how much pressure is applied.

The laser disc buffing apparatus disclosed in U.S. Pat. No. 5,423,103 uses a polishing technique to remove light and medium scratches and smooth and diminish more severe scratches. The apparatus was designed to repair play side damage using a radial polishing motion that is much more tolerated by optical disc players. It achieves this radial polishing motion by using a disc-polishing wheel in an orientation that is substantially perpendicular to the disc. It can be a hand-held, manually operated mechanical device or it can be electrically powered.

Preferably, a buffing apparatus would polish with consistent pressure across the entire optical disc radius. This control allows the laser disc buffing apparatus to apply the highest pressure short of burning, resulting in the maximum effectiveness that can be achieved without damage to the optical disc.

It is generally known that when a loop or hoop with thin walls is in the vertical plane and pushed down on a solid, horizontal surface, it exerts a bi-modal force profile on that surface, with less force exerted directly below the center of the hoop and more force exerted on either side of the center point in the plane of the hoop. Also, it is generally known that when a solid disc in the vertical plane is pushed down on a solid, horizontal surface, it exerts a force on the surface that is a maximum directly below the center of the disc and rolls off on either side of the center in the plane of the disc.

In order to eliminate dust and contaminants from a disc surface, it has been known to use materials such as chamois, mohair, felt or cotton to wipe the surface.

It has further been known to fill the scratches by spreading a waxy or other filter material on the disc, then wiping away the excess to repair a damaged disc surface. It has also been known to use a felt cloth in conjunction with an abrasive solution to buff away scratches on an optical disc.

SUMMARY OF THE INVENTION

The present invention overcomes the above problems in efficiently repairing a damaged optical disc by smoothing part of or the entire readable surface of the disc using an improved buffing wheel in conjunction with a non-abrasive means. The buffing wheel of the present invention overcomes the problems of the prior art by causing the forces between the buffing wheel and the surface of the disc to be substantially uniform so that a substantially flat profile is obtained, thereby facilitating a more uniform buffing of the disc, and allowing a more aggressive abrasive to be used. Thereafter, the use of a non-abrasive cloth under sufficient pressure over the abrasively buffed area eliminates the need for intermediate abrasive steps and/or reduces the number of abrading steps required to restore the disc to its initial optical reflectivity.

The buffing wheel of the invention may be used in connection with the apparatus of U.S. Pat. No. 5,423,103 or with other suitable buffing apparatuses. The buffing wheel includes a hub, flexible spokes, a flexible outer rim, and a flexible abrasive strip around the periphery of the rim. In operation, an optical disc is mounted in a first plane such as in the apparatus in U.S. Pat. 5,423,103. The wheel is then pressed onto the laser readable surface of the disc causing the wheel to partially collapse on and engage the disc under pressure. The flexible spokes of the wheel flex with the wheel rim to facilitate the exertion of a substantially uniform force over the entire area of the laser readable surface of an optical disc to produce a substantially uniform buffing action. The buffing wheel is then rotated until the damaged area has been suitably buffed to remove the scratch damage and which will cause the generation of substantially radially extending fine scratches. Preferably, the disc is rotated during buffing. A non-abrasive cloth is then worked over the buffed area preferably in a substantially dry environment using sufficient pressure to generate heat such that the material of the disc flows to substantially remove the fine scratches and substantially restore the optical reflectivity of the disc to its original condition.

It is contemplated that the use of the non-abrasive means in a preferably substantially dry environment may also be used separately to clean the disc or eliminate minor scratches from the damaged area of the disc. It is further contemplated that the buffing wheel may be sized for different size optical discs including the compact laser disc, the mini laser disc, and record size video laser disc.

Further, it will be appreciated that a plurality of buffing wheels may be used to eliminate or diminish larger scratches in a damaged surface area of the disc.

It is therefore an object of the present invention to provide an improved buffing wheel for a buffing apparatus that will apply a substantially uniform force across the readable area of a disc when buffing to substantially uniformly buff the area.

It is a further object of the present invention to provide an improved buffing wheel with abrasive means to be used in a buffing apparatus that removes or repairs relatively deep scratches or marks from the surface of an optical disc, and to thereafter manually or otherwise buff the surface with a non-abrasive means to substantially remove the fine scratches caused by the abrasive buffing process and restore the optical reflectivity of the disc substantially to its original condition.

Another object of the invention is to provide a method of buffing a disc which eliminates the need for intermediate steps to buff out the scratches on a disc and smooth the entire surface of the disc.

Another object of this invention is to provide a non-abrasive means in a subsequent buffing step or steps for repairing a disc that smooths out the surface of the disc by generating heat on the surface such that the material on the surface flows to smooth scratches on the surface of the disc.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
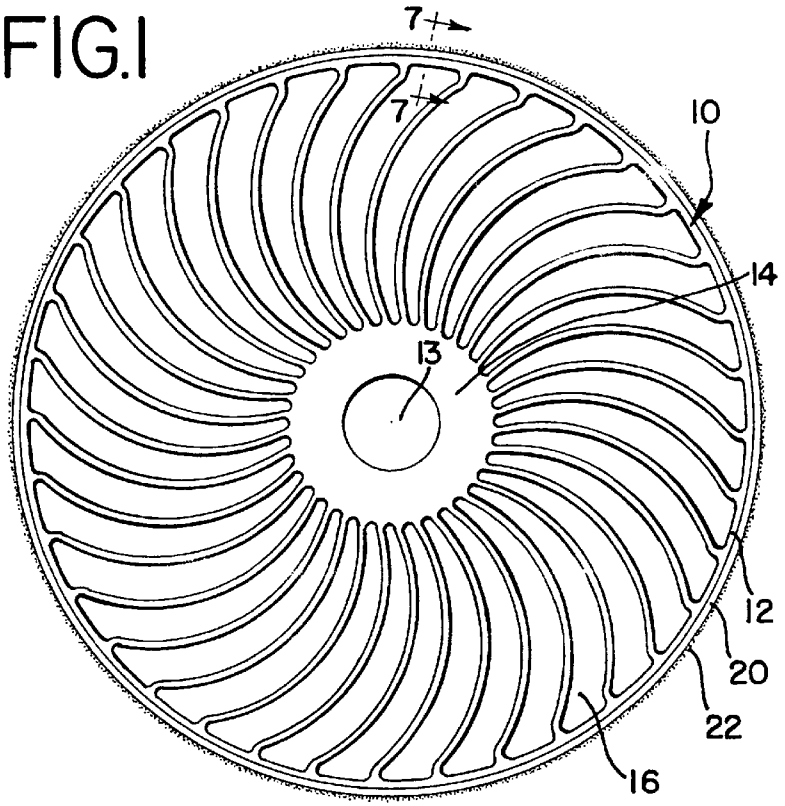
FIG. 1. is a front elevational view of the buffing wheel of the present invention.
Figure 2:
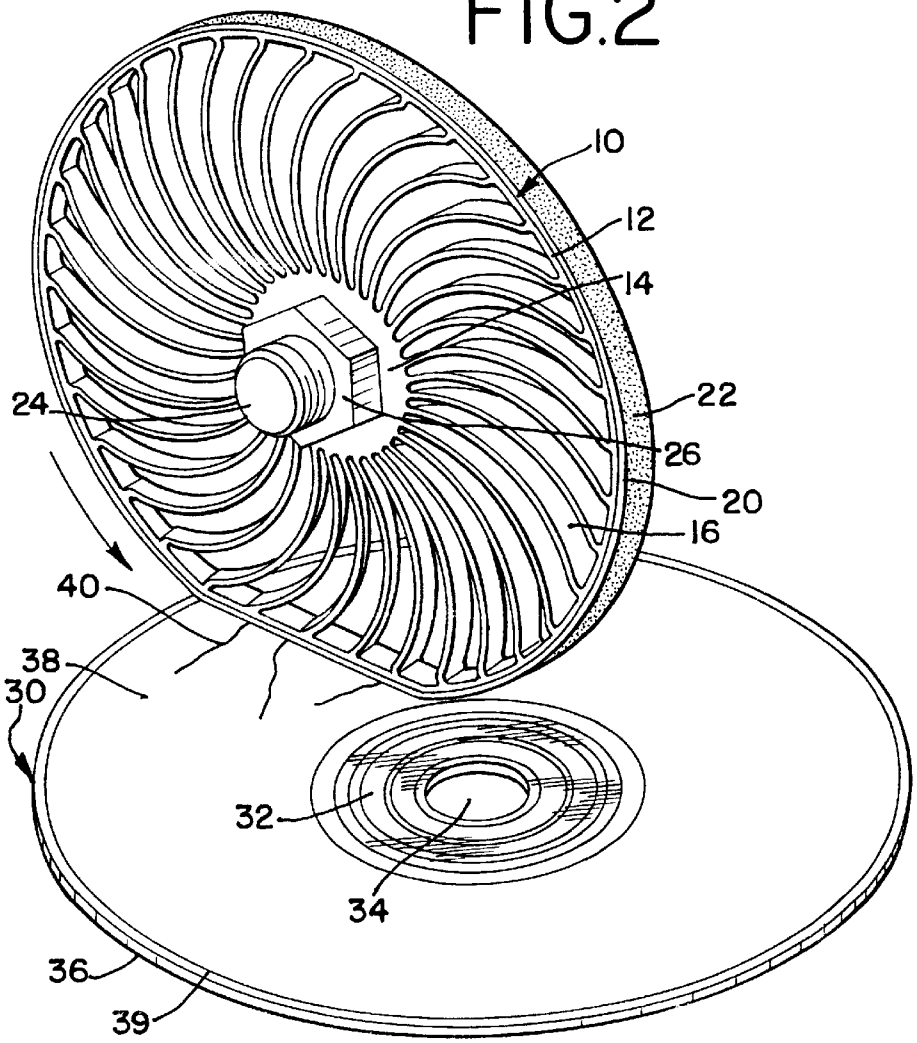
FIG. 2 is a perspective view of the buffing wheel in contact with the surface of a disc with a damaged area.

Referring now to the drawings, and particularly to FIG.1, the buffing wheel of the present invention, generally indicated by the numeral 10, is circular in shape and generally includes an annular thin-walled hoop or rim 12 connected to a hub 14 by a plurality of spaced apart spirally shaped spokes 16. Each of the spokes is spirally formed between the hub and rim, such that a degree of flexibility is achieved that will enable a flattened portion of the rim engaging a disc to apply a substantially uniform force along the length of the flattened portion. This action of the wheel is very important in providing uniform buffing across an optical disc. A hole 13 is provided at the center of the hub 14 for mounting the wheel on a shaft, as seen in FIG. 2 and as further explained hereafter.

The wheel 10 is preferably molded in one piece by any suitable molding technique from a suitable flexible or pliant material, such as a suitable plastic, like a low-density polyethylene. However, the wheel could be made of any suitable material and by any suitable method as long as a substantially uniform force result will be obtained when using the wheel against a disc surface to uniformly buff the surface.

Again, for use in a compact disc repair apparatus the wheel rim would preferably have a thickness of about 0.060 inches, a width of about 0.250 inches, and an outer diameter of about 4 inches.

Figure 7:
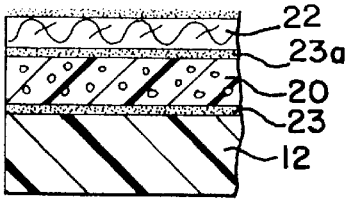
FIG. 7 is a greatly enlarged cross-sectional view taken through the rim of the wheel and the abrasive material substantially along line 7—7 of FIG. 1 for performing the initial abrasive buffing step.

Preferably, the abrasive material used on the periphery of the wheel will be backed by a strip of foam material. As seen in FIGS. 1 and 2, the foam material is designated by the numeral 20, and an abrasive strip 22 is secured to the foam backing 20. Preferably, as shown in FIG. 7, the foam strip will have a coating of pressure-sensitive adhesive 23 on one side for attaching the strip to the wheel rim and a coating of pressure-sensitive adhesive 23*a* on the other side to which the abrasive strip 22 will be attached. Any suitable abrasive strip may be used, such as a 4000 grit Micromesh aluminum oxide abrasive made by Micro-Surface Finishing Products, Inc. of Wilton, Iowa. Micromesh is a trademark owned by Micro-Surface. This abrasive strip includes a woven cloth on which aluminum oxide impregnated latex is cured to provide a buffing surface. Other suitable abrasives may be employed.

Referring now to FIG. 2, the manner of using the buffing wheel 10 to buff a disc 30 is shown. The disc 30 includes a central area 32, a center aperture 34 mountable on a spindle as in the above-mentioned patent, an outer edge 36, and an optical or a laser readable surface 38 between the central area 32 and the laser readable boundary 39. As shown in FIG. 2, the disc 30 is damaged by scratches 40 which interfere with the readability of the disc. The hub 14 is attached to a laser disc-buffing apparatus (not shown) but which could be like that shown in U.S. Pat. No. 5,423,103, the disclosure of which is incorporated by reference. The wheel 10 may be mounted on a suitable driven shaft 24 and secured in place by a nut 26 or otherwise suitably secured to a shaft or spindle. As the buffing wheel 10 is lowered onto the disc 30, the pliant rim 12 and flexible spokes 16 collapse to define a flattened area or portion on the wheel and cause the wheel 10 to spread out over the entire laser readable surface 38 of the disc between the central area 32 and the outer laser readable boundary 39 adjacent the disc edge 36. The unique wheel structure creates a substantially flat uniform force profile across the readable surface 38 of the disc, which facilitates the substantially uniform buffing or polishing of the disc as the wheel is rotatably driven to continually present a flattened profile to the disc. Although FIG. 2 shows the wheel 10 covering the entire readable area of the disc 30, it will be understood that a smaller buffing wheel may be used to only cover a portion of the readable surface 38, if desired. It should be appreciated that the buffing wheel could be employed to buff surfaces other than an optical disc.

To clean or buff a disc, the disc 30 and wheel 10 are preferably simultaneously rotated by the driving means, such as that shown in U.S. Pat. No. 5,423,103. It is preferable that the disc 30 rotate at a substantially slower speed than the buffing wheel 10, and preferably at a ratio of about 60 to 1. The wheel rotates preferably in a direction from the outer edge of the disc towards the center of the disc, while the disc may be rotated in either direction. The buffing action on the disc 30 removes material from the readable surface 38 and repairs the surface by eliminating or repairing the scratches 40. Once the disc 30 is satisfactorily buffed, the wheel 10 is taken out of contact from the disc 30 and the disc can be removed for further processing.

Figure 3:
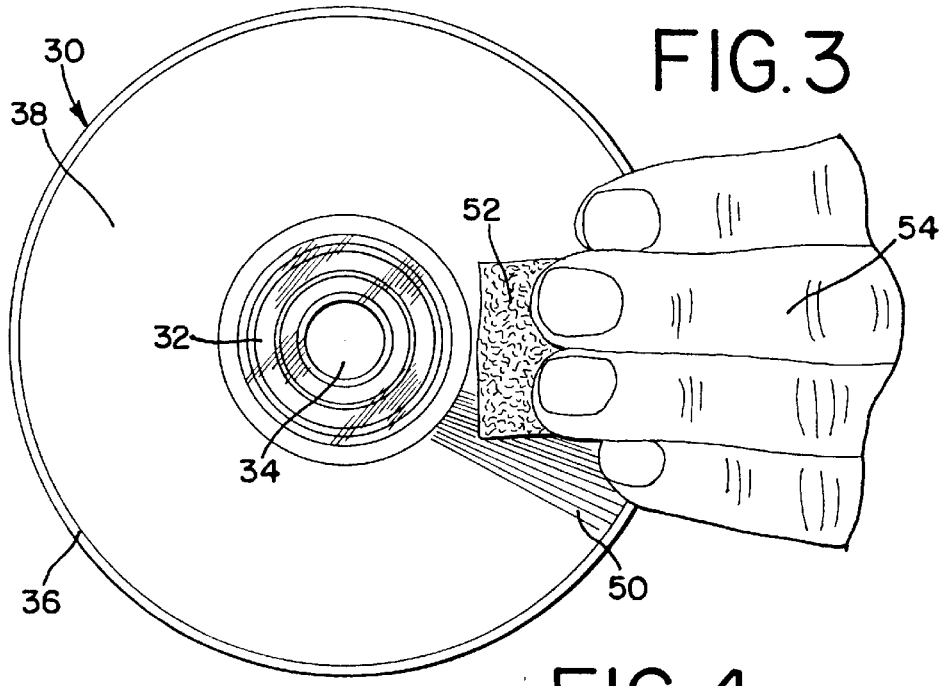
FIG. 3 is a plan view of a disc following buffing by the buffing wheel and showing the manner of manual buffing with a non-abrasive means according to the invention.
Figure 4:
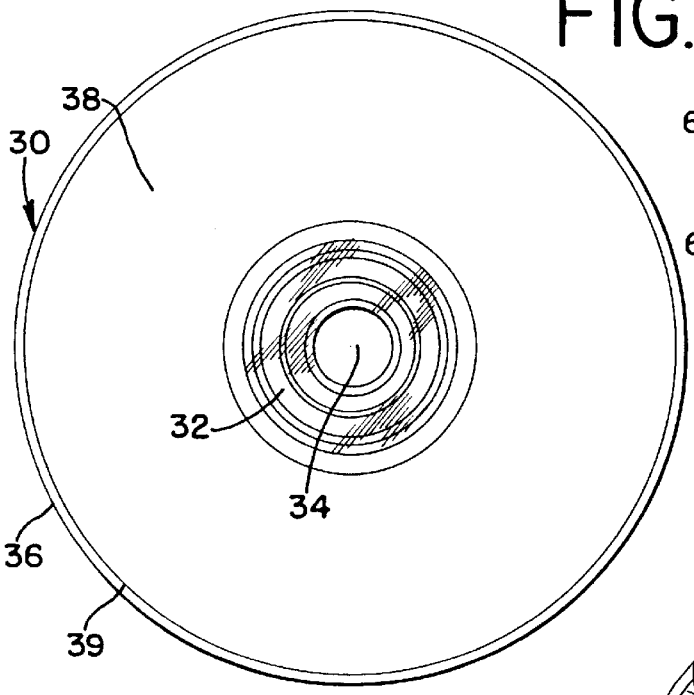
FIG. 4 is a plan view of the disc after the damaged area has been repaired.

Similar to a surface after the application of sand paper, after using the buffing wheel 10, the readable surface of a disc 30 may contain fine or minute scratches 50, as illustrated in the buffed disc of FIG. 3. These scratches resulting from the rotation of the buffing wheel 10 will be substantially uniform scratches extending in a substantially radial, but preferably slightly offset direction on the disc, as shown in FIG. 3. It is understood that different abrasive means may be used in series with each successive abrasive means having finer abrasive material to decrease the size of the scratches on the surface of the disc 30, so long as the non-abrasive means is used to remove the fine scratches remaining from the last abrading step.

Even though the disc 30 may sometimes be read with the presence of small or fine scratches 50, it is preferred to complete the repair process by manually or otherwise buffing the scratches with a non-abrasive material 52. Sufficient pressure is applied to the non-abrasive material 52 over the disc surface to generate heat which causes the material of the plastic layer to flow on a scale that is on the order of the width of scratches left by the previous abrasive step and substantially fill in the fine scratches and substantially restore the level of optical reflectivity of the disc to its original state and eliminate any interference with the correct reading of the data layer. It should be noted that the non-abrasive means may leave behind some incidental fine scratches, but these will not interfere with reading the disc.

Although any suitable non-abrasive material 52 may be used, it has been found that virgin wool felt works well with the present invention. Non-virgin wool may also be used, however, it has been shown that virgin wool is more durable. It has also been found that 100% carbonized wool felt works well, such as Buffalo Felt Products Corp.'s product #1001 C, which has a density of 21.2 lb/cu ft.

Figure 5:
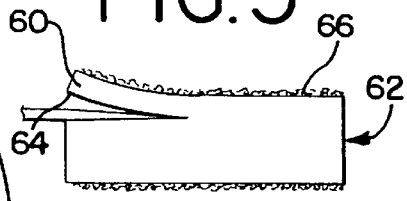
FIG. 5 is side elevational view of a piece of felt and showing the skiving of the felt.

A particular form of non-abrasive material may be a 1/16 inch thick piece of felt 60 skived, as shown in FIG. 5, from a ¼ inch piece of felt 62. The skived side 64 of the felt 62 is flat and uniform compared to the non-skived side 66. In application, the skived side 64 is applied against the buffed area 50 of the readable surface with sufficient force to heat the surface and cause the surface material to flow and substantially eliminate the fine scratches formed by the buffing wheel 10. Any suitably sized piece of felt may be used, preferably in dry form, that can be manually or otherwise applied over the disc surface. This step will then restore the level of optical reflectivity so that the laser beams can accurately read the data layer. Although the felt may be driven in any direction, driving the felt in a direction that is substantially perpendicular to the scratches works best. It is preferred to use the felt by hand 54, as shown in FIG. 3, but it is also possible to attach the felt to the buffing wheel 10, or to a hand tool, as shown in FIG. 6, or to any suitable type of power tool.

Figure 6:
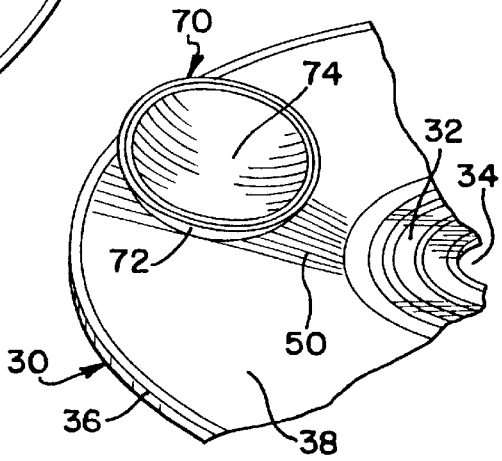
FIG. 6 is a fragmentary perspective view of another embodiment of the non-abrasive means depicting a piece of felt on a convex section of a spoon-shaped tool.

In an alternative embodiment, as shown in FIG. 6, the felt could be used in connection with a spoon-shaped substantially rigid concavo-convexo shaped hand-held device or tool 70. A handle may be provided for the tool, if desired. The felt 72 would be attached to the convex face of the device 70 which would then be placed in engagement with the disc for buffing following buffing with the abrasive. Although a device with a convex shape is preferred, other shapes may be employed that will function to facilitate the buffing with a non-abrasive material. For example, a rigid flat tool with a rim or other structure on one surface could be used, whereby the rim would provide an enclosure for a user's fingers. In terms of the device 70, a person can place the most central digits of his/her hand inside the curvature 74 on the concave side, apply a suitable pressure, and drive the tool with the felt over the surface of the disk to generate sufficient heat to make the material of the surface flow and substantially eliminate the fine scratches. It is also contemplated that the felt may be used individually without the abrasive means 22 to repair areas of a disc 30 having minor damage.

It will be understood that modifications and variations may be effected without departing from the scope of the novel concepts of the present invention, and it is understood that this application is to be limited only by the scope of the appended claims.

The invention is hereby claimed as follows:

1. The method of repairing a damaged area on the surface of an optical disc, wherein said surface of said disc includes laser-penetrable material and the damaged area is first buffed in a buffing apparatus with at least one abrasive means and then buffed by an apparatus or by hand with at least one non-abrasive means, and wherein the buffing apparatus includes a disc-receiving means and a buffing wheel made of a flexible material and having a hub, a flexible annular outer rim, a plurality of flexible spirally spokes extending between said hub and rim, and an abrasive means around the periphery of said rim, and said non-abrasive means includes a piece of cloth, said method comprising the steps of:

mounting the disc in said buffing apparatus in a first plane with said surface of said optical disc being exposed, positioning said buffing wheel in a second plane substantially perpendicular to said first plane and under pressure against said surface, whereby said spirally extending flexible spokes of said buffing wheel and said rim are deformed so that the rim defines a flattened portion in engagement with said disc surface and facilitates a substantially uniform pressure along the area of contact between said buffing wheel and said surface, rotating said buffing wheel such that the abrasive means on the rim removes material from said surface and leaves behind fine scratches, moving said cloth under pressure over the area buffed by the apparatus, whereby the action created between said cloth and said surface generates sufficient heat that causes said laser-penetrable material of said surface to flow, smooth the surface, and substantially remove said fine scratches.

2. The method of claim 1, wherein said abrasive means includes 4000 grit abrasive.

3. The method of claim 1, wherein the disc is moved under the buffing wheel during the buffing step.

4. The method of claim 1, wherein the step of moving the cloth is accomplished manually.

5. The method of claim 4, wherein said cloth is mounted on a hand-held tool.

6. The method of claim 5, wherein the tool is concavo-convexo and substantially rigid.

7. The method of claim 5, wherein the tool is spoon-shaped and substantially rigid.

8. The method of claim 1, wherein said cloth is felt.

9. The method of claim 8, wherein said felt is carbonized wool.

10. The method of claim 8, wherein said felt is skived from a piece of felt and the skived surface is applied to the disc.

11. The method of claim 1, wherein said abrasive means is foam-backed.

12. A buffing wheel adapted for use in a buffing apparatus having an optical disc driving means for repairing a damaged area on the surface of an optical disc, wherein said surface is comprised of a laser-penetrable material, said buffing wheel comprising:

a hub, a plurality of spirally extending flexible spokes extending outwardly from said hub, and a flexible circular outer rim attached to the outer ends of said spokes and adapted to engage said surface, whereby the part of said buffing wheel engaging said disc flattens and applies a substantially uniform force across the engaged surface to produce a substantially uniform buffing of the surface.

13. The buffing wheel of claim 12, wherein said rim extends substantially perpendicular to said spokes.

14. The buffing wheel of claim 13, wherein the wheel is rotatably driven.

15. The buffing wheel of claim 12, wherein said buffing wheel further includes an abrasive means around the periphery of said rim.

16. The buffing wheel of claim 15, wherein said abrasive means includes a foam-backed abrasive strip.

17. The buffing wheel of claim 16, wherein the abrasive strip includes a 4000 grit abrasive embedded in latex.

18. The buffing wheel of claim 17, wherein the abrasive is aluminum oxide.

19. The buffing wheel of claim 12, wherein the hub, spokes and rim are integral.

20. The buffing wheel of claim 12, wherein the wheel is molded in one piece.

21. The buffing wheel of claim 12, wherein the wheel is molded of low-density polyethylene.

22. A buffing wheel for buffing a substantially flat surface comprising:

a hub adapted to be mounted on a shaft, for rotation therewith, a plurality of flexible spokes spirally extending from the hub, and an outer flexible circular rim connected to the outer end of said spokes having a buffing surface extending substantially perpendicular to the spokes and adapted to have mounted thereon an abrasive/buffing material, whereby pressing the wheel against a surface to be buffed deforms the rim in the area of contact with the surface to define a substantially flattened area which applies a substantially uniform force along said flattened area during buffing to produce a substantially uniform buffing of the area.

23. The buffing wheel of claim 22, wherein the wheel is rotatably driven.

24. The buffing wheel of claim 23, wherein the hub, spokes and rim are integral.

25. The buffing wheel of claim 24, wherein the wheel is molded of plastic in one piece.

* * * * *

UNITED STATES PATENT AND TRADEMARK OFFICE

CERTIFICATE OF CORRECTION

PATENT NO. : 5,964,650
DATED : October 12, 1999
INVENTOR(S) : Joseph Born et al.

It is certified that error appears in the above-identified patent and that said Letters Patent is hereby corrected as shown below:

Column 6,
Last line, change "flexible spirally spokes extending" to -- flexible spokes spirally extending --

Signed and Sealed this

Twenty-third Day of April, 2002

*Attest:*

*Attesting Officer*

JAMES E. ROGAN
*Director of the United States Patent and Trademark Office*